US005963435A

United States Patent [19]

Biernson

[11] Patent Number: 5,963,435

[45] Date of Patent: Oct. 5, 1999

[54] APPARATUS FOR COATING METAL WITH OXIDE

[75] Inventor: George A. Biernson, Woburn, Mass.

[73] Assignee: Gianna Sweeney, Boston, Mass.

[21] Appl. No.: 08/823,711

[22] Filed: Mar. 25, 1997

[51] Int. Cl.[6] ..... H02M 7/00

[52] U.S. Cl. ..... 363/13

[58] Field of Search ..... 363/13, 15, 34, 363/125; 205/105, 173; 204/194, 228

[56] References Cited

U.S. PATENT DOCUMENTS

| | | | |
|---|---|---|---|
| 1,965,682 | 7/1934 | Work | 204/1 |
| 1,965,684 | 7/1934 | Work | 204/1 |
| 2,262,967 | 11/1941 | Schenk | 204/58 |
| 2,578,400 | 12/1951 | Cohn | 204/38 |
| 3,836,439 | 9/1974 | Ikegaya et al. | 204/58 |
| 3,915,813 | 10/1975 | Abe et al. | 204/35 N |
| 3,985,629 | 10/1976 | Kimura | 204/58 |
| 4,025,828 | 5/1977 | Sunamori et al. | 361/436 |
| 4,087,341 | 5/1978 | Takahashi et al. | 204/129 |
| 4,160,287 | 7/1979 | Chillier-Duchatel et al. | 363/13 |
| 4,170,739 | 10/1979 | Frusztajer et al. | 307/2 |
| 4,188,270 | 2/1980 | Kataoka | 204/42 |
| 4,452,674 | 6/1984 | Gillich et al. | 204/33 |
| 4,478,689 | 10/1984 | Loch | 204/228 |
| 4,992,155 | 2/1991 | Brodalla et al. | 204/228 |
| 5,352,346 | 10/1994 | Rodriguez | 204/228 |

*Primary Examiner*—Adolf Berhane

[57] ABSTRACT

An electrolysis apparatus for coating a metal, typically aluminum, with an oxide, which applies long voltage pulses to the control electrodes of the thyristors 13, 14, 15, 16. The thyristors control the flow of alternating current between the metal sample 17 and the stainless steel electrolysis tank 18, which typically holds an alkaline water solution. An alternating voltage power source of about 350 volts rms is provided by the transformer 11, and current flow is regulated by the capacitor 12. The long voltage pulse is applied to the control electrode of each thyristor when the thyristor is back-biased and maintained until after it is forward-biased, thereby allowing the thyristor to turn on optimally without generating a current spike. Current spikes can degrade the oxide coating and cause electromagnetic interference.

7 Claims, 4 Drawing Sheets

APPARATUS FOR COATING METAL WITH OXIDE

BACKGROUND

1. Field of Invention

Figure 1:
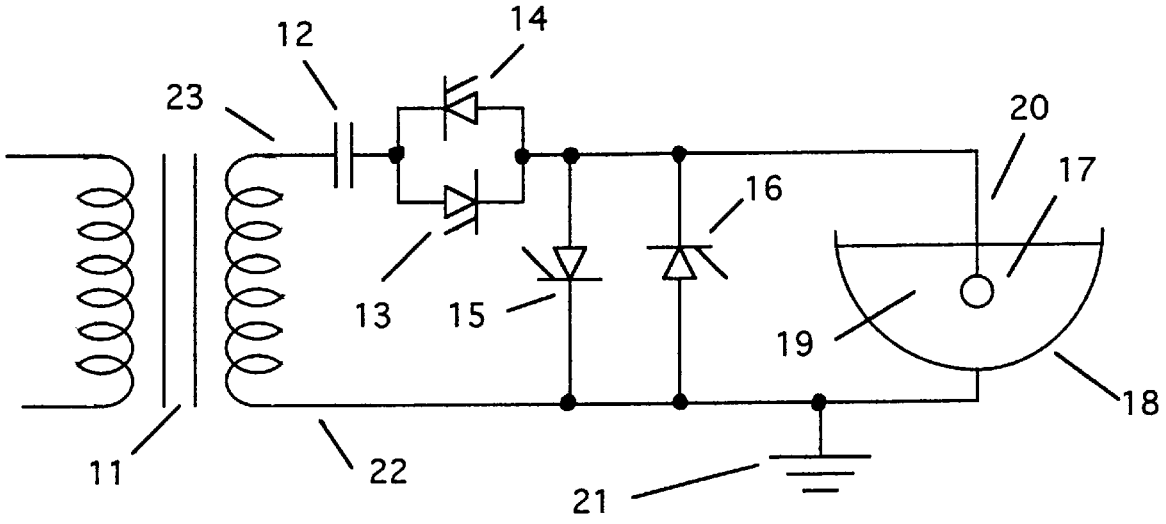

This invention relates to the coating of the surface of a metal with an oxide material to improve its characteristics, which include, but are not limited to, abrasion resistance, heat resistance, corrosion resistance, and electrical resistance.

2. Description of Prior Art

Metals, particularly aluminum and its alloys, have been coated for many years with a thin layer of oxide in order to improve the characteristics of the material, particularly its tolerance to abrasion, oxidation, corrosion and thermal effects. Aluminum and its alloys are soft and chemically active, and so an oxide coating can greatly enhance the applicability of these metals. However, oxide coatings used commercially are porous and do not provide good corrosion protection, and the hardness and thermal properties are limited.

A common means for coating aluminum and its alloys with oxide is an electrolysis process called anodizing. The metal sample is typically placed in an electrolyte solution of 15 percent sulfuric acid, in water, and a positive direct-current voltage, typically 15 to 40 volts, is applied between the aluminum sample and a second electrode. The electrical current that flows in the electrolyte solution is typically about 2 amperes per square decimeter of the metal sample surface.

A new electrolysis process has been developed in Russia that forms greatly improved oxide coatings on aluminum and its alloys, as well as on other metals. For the electrolyte, the process generally uses an alkaline, rather than an acid. A typical electrolyte solution is 2 gram/liter of potassium hydroxide in water. The tank that holds the electrolyte solution is usually stainless steel. An alternating voltage is applied between the metal sample being coated and an inert non-reactive electrode, which is usually the stainless steel tank. The peak voltage is much greater than that used in anodizing. A typical average current per half cycle of the alternating voltage is 10 ampere per square decimeter of the surface of the metal sample.

This process has been implemented using (a) an alternating voltage source of 50 hertz frequency and typically 380 volts rms, provided by a transformer, (b) a capacitor to limit the electric current, and (c) thyristors to control the current flow. When current flows through the tank, a series electric circuit is closed from the transformer output voltage, through the capacitor, through a back-to-back pair of thyristors (called series thyristors), and through the tank electrolysis circuit, which is the electrical conduction path in the electrolyte solution between the metal sample and the stainless steel tank. A back-to-back pair of thyristors, called shunt thyristors, is placed in parallel with the tank electrolysis circuit. (A thyristor is also called a silicon controlled rectifier, abbreviated SCR.)

The series thyristors are excited during every electrical cycle in which the process operates. The shunt thyristors control the flow of current through the tank. When the shunt thyristors are excited, no current flows through the tank. When electric current flows in the electrolyte solution from the metal sample to the tank, it is called anodic current; and when it flows from the tank to the metal sample, it is called cathodic current. If the shunt thyristor having its cathode electrically connected to the tank is appropriately excited during a cycle, no anodic current flows through the tank during that cycle. If the other shunt thyristor is appropriately excited, no cathodic current flows through the tank during that cycle.

Commercially available thyristor driver circuits practically always apply a narrow voltage pulse to the thyristor control electrode, the pulse being very short relative to the period of the alternating current prime power. The pulse makes the voltage of the control electrode positive relative to the cathode for a very short interval of time.

This conventional thyristor driver approach has been used in the prior art implementations of the above described electrolysis process for coating metal with an oxide. It has serious deficiencies. It is extremely difficult, and possibly impractical, to apply the excitation voltage pulse at the optimum time. If it is applied when the thyristor is back biased, the thyristor is not turned on. If it is applied when the thyristor is strongly forward biased, a large current spike is generated, because of the capacitance in the power circuit. Current spikes degrade the quality of the ceramic coating, and generate undesirable electromagnetic interference.

OBJECTS AND ADVANTAGES

Several objects and advantages of this invention are:

(a) in the above described electrolysis process for applying an oxide coating to a metal sample, to control the thyristors in such a manner as to minimize current spikes;

(b) to achieve better quality in the oxide coating on the metal sample because of the great reduction of current spikes;

(c) to minimize electromagnetic interference radiation that would be caused by current spikes;

(d) to provide a thyristor control approach that is easier to implement, and more reliable, because it does not require critical timing adjustment.

(e) to provide a means of achieving a non-unity ratio of anodic to cathodic current within a single electrical power cycle.

Further objects and advantages of this invention will become apparent from a consideration of the drawings and ensuing description.

DRAWINGS FIGURES

FIG. 1 shows the basic electrical power circuit used in the invention; this circuit employs thyristors and a capacitor to alter the alternating current prime power supplied by a transformer to form the electric current flowing in the electrolysis tank.

Figure 2:
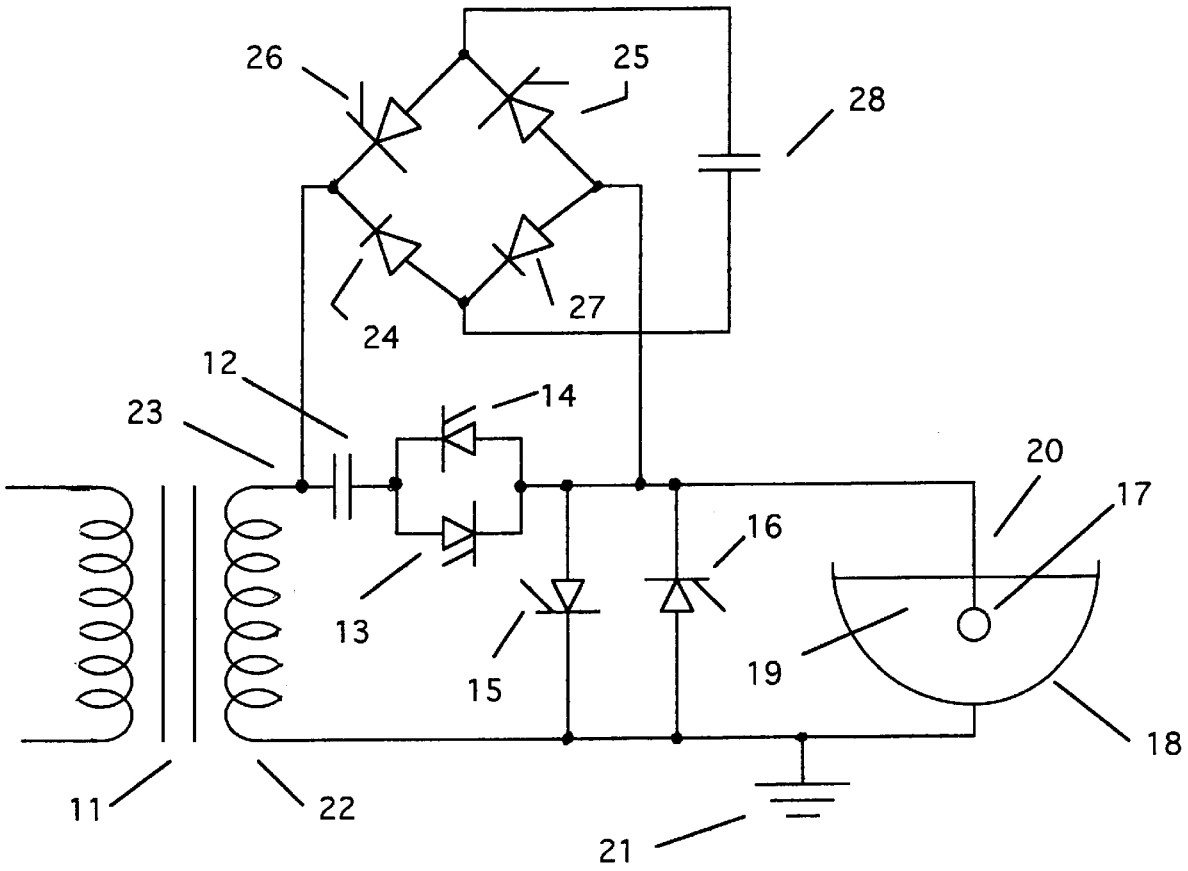

FIG. 2 adds elements to the circuit of FIG. 1 to form an electrical power circuit that can generate a non-unity ratio of cathodic to anodic current within a single electrical power cycle.

Figure 3A:
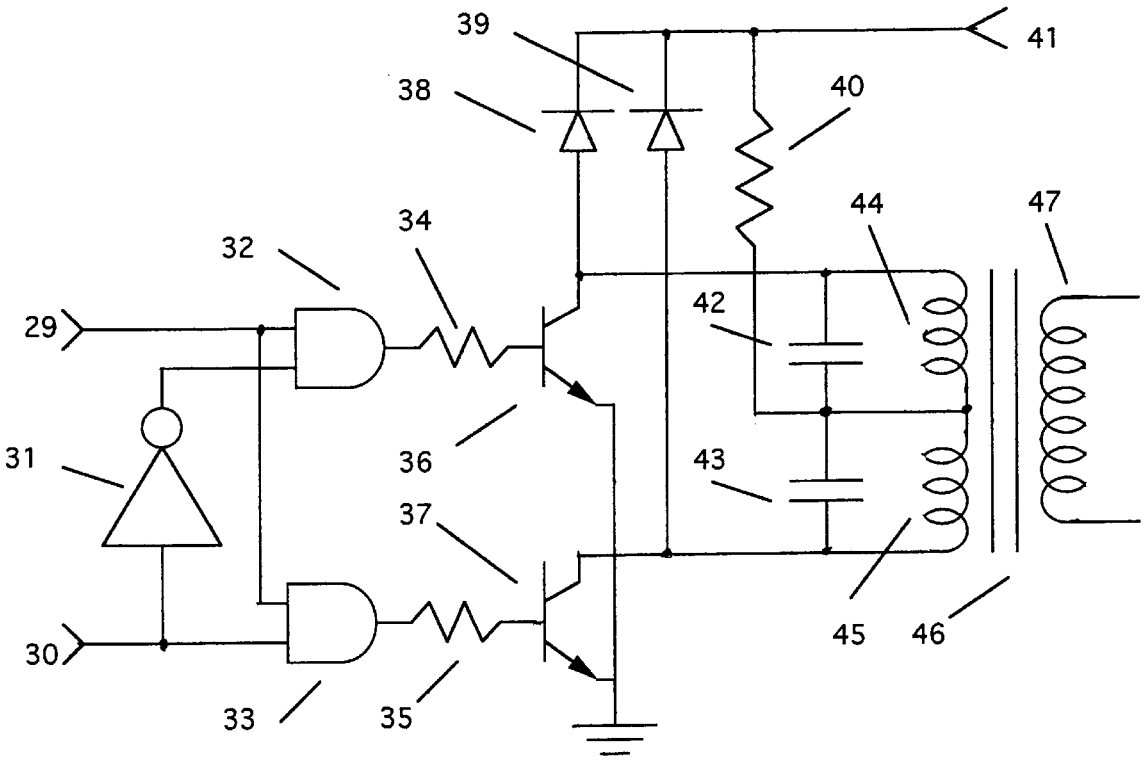
Figure 3B:
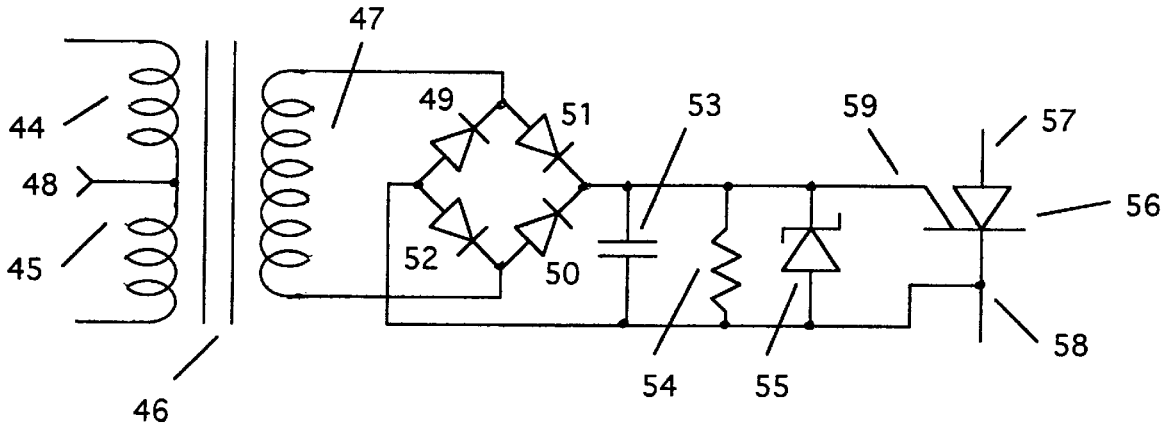

FIG. 3A and 3B shows a circuit for generating the desired control electrode voltage of a thyristor in response to a logic command signal. FIG. 3A shows the circuit elements in the primary circuit of the isolation transformer, and FIG. 3B shows the circuit elements in the secondary circuit of the isolation transformer.

REFERENCE NUMERALS IN DRAWINGS

11—power transformer
12—main capacitor for controlling tank current
13—series thyristor supplying anodic current to tank
14—series thyristor supplying cathodic current to tank
15—shunt thyristor that bypasses anodic current around tank

16—shunt thyristor that bypasses cathodic current around tank
17—metal sample being coated with oxide
18—electrolysis tank that holds electrolyte solution and metal sample
19—electrolyte solution held in the tank
20—wire coupled to the metal sample
21—electrical ground
22—grounded secondary terminal of power transformer 11
23—ungrounded secondary terminal of power transformer 11
24, 25, 26, 27 —thyristors in bridge circuit connected to bias capacitor 28
28—bias capacitor for controlling ratio to cathodic to anodic current
29—TTL logic signal that excites the thyristor control electrode when HIGH
30—TTL logic oscillator signal, typically at 40 KHz
31—inverter TTL logic circuit
32, 33—AND TTL logic circuits
34, 35—resistors
36, 37—transistors
38, 39—diodes
40—power resistor that limits current in transistors
41—power supply voltage for thyristor control electrode driver circuit
42, 43—filtering capacitors
44, 45—primary windings of isolation transformer 46
46—transformer that isolates thyristor control voltage from ground
47—secondary winding of isolation transformer 46
48—center tap of primary windings of isolation transformer 46
49, 50, 51, 52—diodes in bridge rectifier circuit
53—capacitor that holds direct-current voltage supplied by bridge rectifier
54—resistor for limiting thyristor control voltage
55—zener diode for limiting thyristor control voltage
56—thyristor being controlled
57—anode of thyristor being controlled
58—cathode of thyristor being controlled
59—control electrode of thyristor being controlled

DESCRIPTION OF THE INVENTION

The present invention overcomes disadvantages of the prior art by giving an improved means of controlling the thyristors employed in the electrolysis process that forms an oxide coating on a metal sample. The control electrodes of the series and shunt thyristors that control the electric current flowing in the electrolysis tank are excited by long voltage pulses, each of which has a duration that is typically about ⅓ of the period of the electrical alternating current prime power. (In the U.S.A, the electrical prime power period is 1/60 second, while in Russia it is 1/50 second.) The long voltage excitation pulse is applied to the control electrode of a thyristor when it is back biased, and this pulse holds the control electrode voltage positive until the thyristor becomes forward biased. When the external circuit raises the voltage on the thyristor anode above that of the cathode, by an amount that exceeds the small threshold voltage of the thyristor, the thyristor is automatically turned on at the optimum instant, and current spikes are essentially eliminated.

Description—Basic Power Circuit (FIG. 1)

FIG. 1 shows the electric power circuit used in the invention. The process produces an oxide coating on the metal sample 17, which is often an alloy of aluminum. The metal sample 17 is immersed in an electrolyte water solution 19 contained in a tank 18, which is usually made of stainless steel. The tank is electrically connected to ground 21. The metal sample is connected to a wire 20, which is covered by an inert insulated coating in the portion immersed in the electrolyte solution, so that the wire metal does not react or directly conduct to the electrolyte solution.

The transformer 11 delivers at prime alternating-current power frequency a voltage typically between 300 and 400 volts rms. One of the terminals 22 of the transformer is grounded, and so is electrically connected directly to the tank 18. The capacitance value of the capacitor 12 is chosen to regulate the value of the current flowing in the electrolyte solution between the metal sample 17 and the tank 18. About 100 microfarad of capacitance is needed to achieve 10 amperes of average current in the tank during a half cycle of the alternating current prime power. Typically the average current in a half cycle flowing within the tank is of the order of 10 amperes per square decimeter of metal-sample surface.

The electrical control of the current in the tank is achieved by the series thyristors 13, 14 and by the shunt thyristors 15, 16. The series thyristors 13, 14 are excited during every electrical cycle of the process from start to stop. When shunt thyristor 15 is excited during a cycle, the tank is bypassed during the anodic half-cycle, and so no anodic current flows during that cycle. When shunt thyristor 16 is excited during a cycle, the tank is bypassed during the cathodic half-cycle, and so no cathodic current flows during that cycle.

The unique characteristic of this invention is the means for exciting the thyristors. In the prior art, the thyristors are excited by narrow pulses, that must be accurately timed relative to the electrical current waveform in order to minimize current spikes. This is very difficult to achieve optimally, because the current waveform is not sinusoidal, and the phase and waveform of the current changes greatly as the shunt thyristors are turned on and off.

In this invention, long voltage pulses are applied to the control electrodes of the thyristors. The control electrode of a thyristor is excited with a positive voltage (relative to the cathode) while the thyristor is back biased (i.e., the anode-to-cathode voltage is negative), and this positive voltage is maintained on the control electrode for about ⅓ of a period of the electrical alternating current prime power. When the anode-to-cathode voltage across a thyristor reverses to become positive, that thyristor is automatically turned on at the optimum instant, and essentially no current spike is generated. The thyristor turns itself on when its anode-to-cathode voltage exceeds a small positive threshold value.

The voltage on the ungrounded terminal 23 of the transformer 11 is sensed to provide a signal for synchronizing the control signals delivered to the thyristors. A synchronizing pulse is generated at the instant that the transformer voltage 23 changes from negative to positive. The voltage waveforms applied to the control electrodes of the four thyristors are typically as follows, where one period of the 60 Hz or 50 Hz alternating current prime power waveform is defined as 360 electrical degrees:

Thyristors 13 and 15: The thyristor control voltage is applied from 250 to 370 electrical degrees following the synchronizing pulse of each cycle.

Thyristors 14 and 16: The thyristor control voltage is applied from 70 to 190 electrical degrees following the synchronizing pulse of each cycle.

The control electrodes of series thyristors 13, 14 are excited with the specified voltage waveforms during every electrical cycle from the beginning to the end of the process. When the control electrodes of the shunt thyristors are not excited, electrical current flows through the electrolysis tank. If the control electrode of the shunt thyristor 15 is excited during one electrical cycle, no anodic current flows in the tank for that cycle. If the control electrode of the shunt thyristor 16 is excited during one electrical cycle, no cathodic current flows in the tank for that cycle.

The process is usually operated in an intermittent manner, in order to allow the metal sample to cool. The current is typically controlled to flow through the tank 18 for a few seconds, and then is turned off for a few seconds by exciting the shunt thyristors 15, 16.

The electrical resistance in the electrolysis tank, from the metal sample 17 to the tank 18, is nonlinear. When alternating anodic-cathodic currents flow through the tank, the peak negative voltage of the metal sample is typically about −100 volt, and the peak positive voltage is typically about +500 volt.

Description—Non-Unity Ratio of Cathodic to Anodic Current (FIG. 2)

It is often desirable that the average cathodic current be different from the average anodic current. As a typical value, assume that the average cathodic current should exceed the average anodic current by 20 percent. This condition can be achieved, at least approximately, by exciting thyristor 15 once every 10 electrical cycles. This approach blocks the anodic current for one cycle. Because of the nonlinear nature of the resistance of the electrolysis tank, the integral of current in the subsequent cathodic current pulse is about twice as large as for other cathodic current pulses. Hence, the average anodic current is decreased by 10 percent because one in 10 anodic current pulses is eliminated; and the average cathodic current is increased by about 10 percent because the integrated cathodic current is approximately doubled for one in 10 of the cathodic current pulses. Therefore, the resultant average cathodic current is about 20 percent greater than the average anodic current.

This approach allows one to vary the ratio of cathodic current to anodic current, averaged over many electrical cycles. However, it may be desirable to achieve the desired average ratio within a single cycle. This can be achieved with the circuit shown in FIG. 2.

In FIG. 2, capacitor 12 is now called the "main capacitor" and capacitor 28 is called the "bias capacitor". The capacitance of the main capacitor 12 is denoted Cm and the capacitance of the bias capacitor 28 is denoted Cb. This circuit achieves, within a single electrical cycle, a ratio of average cathodic current to average anodic current equal to $(1+C_b/C_m)$. If the anodes and cathodes of thyristors 24, 25, 26, 27 are reversed, this circuit would produce more anodic current than cathodic current, and the ratio of average anodic current to average cathodic current within a single electrical cycle would then be $(1+C_b/C_m)$.

Thyristors 24, 25, 26, 27 are excited every other electrical cycle, with thyristors 24, 25 being excited in alternate electrical cycles from thyristors 26, 27. The signals for exciting the thyristors 24, 25, 26, 27 are obtained from the signal that excites thyristor 14, which is gated as described in items (a) to (c) listed below. In the following, the excitation signals are treated as digital logic signals, which are denoted as ONE when the required excitation voltage is applied to the thyristor control electrode, and ZERO when zero voltage is applied to the control electrode. The current in the tank is sensed by measuring the current flowing from tank 18 to ground 21. From this tank current signal, a cathodic current logic signal is formed, which is ONE when cathodic current flows in the tank, and ZERO when the tank current is anodic or zero. When the circuit of FIG. 2 is used, the shunt thyristors 15, 16 are turned on and off together. During a single electrical cycle, both 15 and 16 are excited, or neither 15 or 16 is excited. The rules for exciting thyristors 24, 25, 26, 27 are as follows:

(a) Thyristors 24, 25, 26, 27 are not excited during an electrical cycle in which thyristors 15 and 16 are excited.

(b) During an electrical cycle in which thyristors 15, 16 are not excited, either thyristor pair 24, 25 is excited, or thyristor pair 26, 27 is excited; these pairs being excited in alternate cycles.

(c) The logic waveform for exciting the thyristor pair 24, 25 or the thyristor pair 26, 27 is the logic AND of the logic signal that excites thyristor 14 and the cathodic current logic signal. Thus, thyristors 24, 25, 26, 27 are excited only when cathodic current flows in the tank.

If one desires more anodic current than cathodic current, the anodes and cathodes of thyristors 24, 25, 26, 27 are reversed, and item (c) above is replaced with item (d), which is (d) From the tank current, an anodic current logic signal is formed, which is ONE when anodic current flows in the tank, and ZERO when the tank current is cathodic or zero. The logic signal for exciting the thyristor pair 24, 25 or the thyristor pair 26, 27 is the logic AND of the logic signal that excites thyristor 13, and the anodic current logic signal. Thus, thyristors 24, 25, 26, 27 are excited only when anodic current flows in the tank.

The requirements of items (c) and (d) are used to minimize undesirable current spikes in the circuit. Control commands might be derived by appropriately setting the timing of the commands to the thyristors 24, 25, 26, 27, which might achieve an acceptable level of current spikes. Current spikes can be reduced by placing inductors in series with capacitor 28 and capacitor 12.

The capacitors in the circuits of FIGS. 1 and 2 should have bleeding resistors across the terminals so that they do not hold unsafe electrical charges long after the process is turned off. A typical value for the product of bleeding resistance times capacitance is 20 sec.

Description—Circuit to Apply Long Voltage Pulse to Thyristor Control Electrode (FIGS. 3A, 3B)

FIGS. 3A and 3B show a circuit for applying the required excitation signal to the control electrode of any one of the thyristors of FIG. 1 or FIG. 2. FIG. 3A shows the elements in the primary circuit of the isolation transformer 46, and FIG. 3B shows the elements in the secondary circuit of transformer 46. Transformer 46 isolates the thyristor control circuit from the system ground 21, shown in FIGS. 1 and 2.

Signal 29 in FIG. 3A is the command input signal, which is a TTL-compatible logic signal. The command logic signal 29 is HIGH or ONE when voltage excitation is applied to the control electrode of the corresponding thyristor, and it is LOW or ZERO when the control electrode is not excited. Signal 30 is an oscillator signal, and is a TTL-compatible logic square wave, typically at 40 KHz. The inverter 31 may be implemented by a SN7404 integrated circuit, and the AND gates 32, 33 by a SN7408 integrated circuit. When the command logic signal 29 is LOW, the signals from both of the 32, 33 AND gates are LOW. When the command logic signal 29 is HIGH, the signals from the AND gates 32, 33 are TTL square waves of opposite phase at the oscillator frequency.

The resistors 34, 35 limit the base currents in the transistors 36, 37. When the command logic signal 29 is HIGH, the transistors 36, 37 are turned on and off at the oscillator frequency, in opposite phases. The collectors of the transistors are connected in a push-pull electrical circuit to the primary windings 44, 45 of the isolation transformer 46. The transformer 46 can be implemented by a ferrite toroid. The center tap 4 8 of the primary windings is connected to the power supply voltage 41 (which is typically about +20 volts) through the resistor 40, which limits the collector currents in the transistors. The clamping diodes 38, 39 prohibit the transistor collector voltages from appreciably exceeding the power supply voltage 41. Capacitors 42, 43 minimize high-frequency transients in the circuit.

FIG. 3B shows that the secondary winding 47 of the transformer is fed to a bridge-rectifier circuit, consisting of four diodes 49, 50, 51, 52. An alternating voltage at the oscillation frequency is generated across the secondary winding 47 when the command signal 29 is HIGH. The bridge rectifier converts this alternating voltage to a direct-current voltage, which is applied to filter capacitor 53. The load resistor 54 and the zener diode 55 limit the maximum direct-current voltage across capacitor 53, so that it does not exceed the voltage limit of the thyristor control electrode. The voltage across the capacitor 53 is applied to the thyristor 56, between the control electrode 59 and the cathode 58. The cathode. 58 and anode 57 of the thyristor 56 are connected to external circuit elements, as was shown in FIGS. 1 and 2.

By this means, a positive voltage is applied between the control electrode 59 and the cathode 58 of the thyristor 56 whenever the command signal 29 is HIGH, and zero voltage is applied whenever the command signal 29 is LOW.

A thyristor acts as an open circuit between the anode and cathode until the control electrode is excited with a positive voltage between the control electrode and the cathode. If a positive voltage of sufficient value is applied to the control electrode when the anode voltage is positive relative to the cathode, the thyristor switches ON, and acts like a diode until the voltage on the anode becomes negative relative to the cathode. If the positive voltage is applied to the control electrode when the thyristor anode voltage is negative relative to the cathode, nothing happens.

Summary, Ramifications, and Scope

Accordingly, the reader will see that the new method of controlling thyristors provided by this invention can appreciably improve the previously described process of applying an oxide coating to a metal. Since current spikes are essentially eliminated, the oxide coating can have higher quality, and electromagnetic interference is greatly reduced. Besides, the control equipment is greatly simplified, because accurate timing of the thyristor control pulses is not required.

The prior art has used accurately timed narrow pulses to excite the thyristors. This invention applies a long pulse to the control electrode of each thyristor, which starts when the thyristor is back biased, and continues until the thyristor is forward biased, thereby turning the thyristor on at the optimum time. The thyristor requires a small positive threshold voltage on the anode, relative to the cathode, before it is turned on.

Commercially available thyristor controllers are generally designed to control inductive loads, for which a narrow thyristor excitation pulse is needed. There does not appear to be a commercially available thyristor controller that applies a long excitation pulse. This patent describes a thyristor controller circuit for applying a long excitation pulse to a thyristor control electrode, which can be used to implement the thyristor control principle of this invention.

It is often desirable to achieve a non-unity ratio of anodic to cathodic current. This can be achieved within a single electric power cycle with the circuit of FIG. 2.

Although the description above contains many specificities, this should not be construed as limiting the scope of the invention, but as merely providing illustrations of some of the presently preferred embodiments of this invention. Thus, the scope of the invention should be determined by the appended claims and their legal equivalents, rather than by the examples given.

What is claimed is:

1. An electric circuit for implementing an electrolysis process that applies an oxide coating to the surface of a metal by immersing said metal in an electrolyte water solution, and applying an alternating voltage of more than 250 volts peak-to-peak between said metal and an inert electrode, wherein said electric circuit consists of the series connection of (a) an alternating voltage power source, (b) a capacitor, (c) a pair of back-to-back thyristors, called series thyristors, and (d) the tank electrolysis circuit, which is the electric conduction path between said metal sample and said inert electrode, and where there is additionally (e) a pair of back-to-back thyristors, called shunt thyristors, in parallel with said tank electrolysis circuit; wherein the improvement comprises the following: the control electrode of each thyristor of said electric circuit is excited by a long voltage pulse, of duration more that 5 percent of the period of said alternating voltage power source, where said long voltage pulse is applied to said control electrode when the anode voltage of said thyristor is less than the cathode voltage, and where said long voltage pulse is maintained until said anode voltage of said thyristor exceeds said cathode voltage by the excitation threshold of said thyristor, thereby allowing said thyristor to turn on.

2. The electric circuit of claim 1, wherein the duration of said long voltage pulse is more than 10 percent of said period of said alternating voltage power source.

3. The electric circuit of claim 1, further including a circuit addition that achieves a non-unity ratio of average anodic current to average cathodic current, where said circuit addition has a thyristor bridge circuit with a pair of opposing terminals connected between said alternating voltage power source and said tank electrolysis circuit, and where the other pair of opposing terminals of said thyristor bridge circuit are connected across a capacitor, where each arm of said thyristor bridge circuit consists of the anode-cathode circuit of a thyristor, where the four thyristors of said bridge circuit are oriented so that current can only flow within said bridge circuit in a single direction between said alternating voltage power source and said tank electrolysis circuit.

4. The electric circuit of claim 3 wherein the control electrode of each thyristor of said circuit addition is excited by a long voltage pulse, of duration more that 5 percent of said period of said alternating voltage power source, where said long voltage pulse is applied to said control electrode when the anode voltage of said thyristor is less than the cathode voltage, and where said long voltage pulse is maintained until said anode voltage of said thyristor exceeds said cathode voltage by the excitation threshold of said thyristor, thereby allowing said thyristor to turn on.

5. The electric circuit of claim 4, wherein the control electrode of said thyristor of said circuit addition is excited by said long voltage pulse only when the current in said tank electrolysis circuit is cathodic, if the thyristors of said circuit addition allow current to flow within said circuit addition from said tank electrolysis circuit to said alternating voltage power source, or only when said current in said tank electrolysis circuit is anodic, if the thyristors of said circuit addition allow current to flow within said circuit addition from said alternating voltage power source to said tank electrolysis circuit.

6. The electric circuit of claim 1, further including a thyristor excitation circuit for applying said long voltage pulse to said control electrode of said thyristor of said electric circuit, wherein said thyristor excitation circuit generates an oscillating voltage having a fundamental frequency that is at least 50 times greater than the frequency of said alternating voltage power source, where said oscillating voltage is applied to the primary winding of a transformer, and where the alternating voltage from the secondary winding of said transformer is rectified and filtered to form a direct-current voltage, which is applied between said control electrode and the cathode of said thyristor.

7. The electric circuit of claim 4, further including a thyristor excitation circuit for applying said long voltage pulse to said control electrode of said thyristor of said electric circuit, wherein said thyristor excitation circuit generates an oscillating voltage having a fundamental frequency that is at least 50 times greater than the frequency of said alternating voltage power source, where said oscillating voltage is applied to the primary winding of a transformer, and where the alternating voltage from the secondary winding of said transformer is rectified and filtered to form a direct-current voltage, which is applied between said control electrode and the cathode of said thyristor.

* * * * *